US006679029B2

(12) United States Patent
Clay

(10) Patent No.: US 6,679,029 B2
(45) **Date of Patent: *Jan. 20, 2004**

(54) APPARATUS AND METHODS FOR PACKAGING AND DISTRIBUTING COMBINATIONS OF COMPLEMENTARY ITEMS

(75) Inventor: Forrest Kelly Clay, 1218 Linden La., Worland, WY (US) 82401

(73) Assignee: Forrest Kelly Clay

( * ) Notice: Subject to any disclaimer, the term of this patent is extended or adjusted under 35 U.S.C. 154(b) by 146 days.

This patent is subject to a terminal disclaimer.

(21) Appl. No.: 09/957,904

(22) Filed: Sep. 21, 2001

(65) Prior Publication Data

US 2002/0084205 A1 Jul. 4, 2002

Related U.S. Application Data

(63) Continuation-in-part of application No. 09/922,976, filed on Aug. 6, 2001, now abandoned, which is a continuation-in-part of application No. 09/618,194, filed on Jul. 18, 2000, now Pat. No. 6,293,393.

(51) Int. Cl.[7] ..... B65B 27/00
(52) U.S. Cl. ..... 53/442; 53/445
(58) Field of Search ..... 53/48.2, 48.3, 53/154, 155, 171, 202, 397, 398, 441, 442, 445, 449; 206/139, 140, 216–218, 427, 434, 497, 541, 545, 549, 764; 229/120.011; 426/120

(56) References Cited

U.S. PATENT DOCUMENTS

| | | | | |
|---|---|---|---|---|
| 2,287,729 A | | 6/1942 | Fallert | 229/51 |
| 2,290,971 A | | 7/1942 | King | 229/52 |
| 2,487,293 A | | 11/1949 | Belsinger | 229/15 |
| 2,694,518 A | | 11/1954 | Zanck et al. | 229/15 |
| 3,195,719 A | * | 7/1965 | Giesler | 206/216 |
| 3,759,373 A | | 9/1973 | Werth et al. | 206/65 C |
| 3,759,378 A | * | 9/1973 | Werth | 229/120.011 |
| 4,078,357 A | | 3/1978 | Ida | 53/26 |
| 4,269,308 A | | 5/1981 | Platt | 206/150 |
| 4,471,870 A | * | 9/1984 | Uhlig | 206/427 |
| 4,533,052 A | | 8/1985 | Fruchey et al. | 206/602 |
| 4,795,028 A | | 1/1989 | Wittig et al. | 206/217 |
| 4,819,793 A | | 4/1989 | Willard et al. | 206/162 |
| 4,919,260 A | | 4/1990 | Cunningham | 206/150 |
| 5,056,659 A | | 10/1991 | Howes et al. | 206/217 |
| 5,299,733 A | | 4/1994 | Werth | 229/120.011 |
| 5,372,827 A | | 12/1994 | Brauner et al. | 426/106 |
| 5,657,874 A | * | 8/1997 | Hustad et al. | 206/764 |
| 5,664,671 A | | 9/1997 | Nedblake, Jr. | 206/217 |
| 5,676,244 A | | 10/1997 | Green et al. | 206/221 |
| 5,727,679 A | | 3/1998 | Newarski | 206/222 |
| 5,765,336 A | | 6/1998 | Neagle et al. | 53/201 |
| 5,816,411 A | | 10/1998 | Smith | 206/782 |
| 5,996,316 A | | 12/1999 | Kirschner | 53/443 |
| 6,003,287 A | | 12/1999 | Ballestrazzi et al. | 53/546 |
| 6,026,952 A | | 2/2000 | Brooks | 206/216 |
| 6,058,679 A | | 5/2000 | Ziegler et al. | 53/448 |
| 6,123,214 A | | 9/2000 | Goebel | 220/23.4 |
| 6,293,393 B1 | | 9/2001 | Clay | 206/217 |

* cited by examiner

*Primary Examiner*—Jim Foster
(74) *Attorney, Agent, or Firm*—Woodcock Washburn LLP

(57) ABSTRACT

Apparatus and methods for packaging combinations of complementary items are disclosed. A combined package according to the invention includes a first container containing a first item and a second container containing a second item that complements the first item. A packaging material at least partially surrounds both the first and second containers, thus holding the first and second containers in mutual abutment. The containers can be shaped and positioned relative to one another such that the combined package has an overall shape that is generally rectangulodal and suitable for palletization. Apparatus and methods for manufacturing such combined packages are also disclosed.

11 Claims, 6 Drawing Sheets

APPARATUS AND METHODS FOR PACKAGING AND DISTRIBUTING COMBINATIONS OF COMPLEMENTARY ITEMS

CROSS-REFERENCE TO RELATED APPLICATIONS

This application is a continuation-in-part of U.S. patent application Ser. No. 09/922,976, filed Aug. 6, 2001, abandoned which is a continuation-in-part of U.S. patent application Ser. No. 09/618,194, filed Jul. 18, 2000, now U.S. Pat. No. 6,293,393. The subject matter disclosed herein is related to the subject matter disclosed in U.S. patent application Ser. No. 10/037,893, filed Oct. 23, 2001 pending. The subject matter disclosed in each of the above-referenced patents and patent applications is hereby incorporated h em by reference.

FIELD OF THE INVENTION

This invention relates generally to packages and packaging systems. More particularly, the invention relates to apparatus and methods for packaging and distributing combinations of complementary items as single, palletizable products.

BACKGROUND OF THE INVENTION

It is well known that consumers frequently associate certain complementary items with one another, and that consumers frequently use such complementary items in combination. For example, a consumer might be inclined to eat peanuts when drinking beer, or to replace his oil filter when he changes his oil. To capitalize on this, packagers and distributors of such complementary items have attempted to increase sales of both items by tying sales of certain items to sales of other items that are often associated with them. For example, a seller of popcorn might offer a popcorn purchaser a "cents-of" coupon that can be redeemed with the purchase of a case of soda, or a seller of oil filters might offer an oil filter coupon to the purchaser of a case of motor oil.

Although this approach provides the purchaser with an incentive to purchase both items, such an approach requires the purchaser to actually locate and retrieve both items. The extra effort required to locate the additional item, and then carry it or place it into a shopping cart, for example, can often be just enough to discourage the purchaser from making the additional purchase. Even if the complementary items are placed in reasonable proximity to each other, the consumer can still be dissuaded from buying both items simply because the consumer has to pick up and carry more than one item.

Occasionally, industries such as the beverage and cereal industries offer additional incentives to the purchaser in the form of promotional items (a.k.a. "premiums"). Such promotional items are typically free items that the seller gives to the buyer in exchange for the purchase of the beverage or cereal product. Examples of such promotional items can include toys, tee shirts, videos, and the like. Frequently, the premiums are offered in separate packages, making it difficult or undesirable for the purchaser to carry both the base item (e.g., the beverage or cereal product) and the premium. The premium could be shrink-wrapped, for example, or otherwise attached to the base item, but this approach results in an end-product that is difficult to mass-produce, palletize, store, transport, market, and display in large quantities because of its generally odd overall shape. That is, it is difficult to stack a large number of such packages because gaps between adjacent packages cause instability in the stack.

It would be advantageous, therefore, to manufacturers, distributors, and merchandisers of such complementary items if apparatus and methods were available that entice the consumer to purchase combinations of complementary items, without requiring the consumer to select and carry separate items. Thus, there is a need in the art for apparatus and methods for packaging and distributing combinations of complementary items as single products that can be efficiently palletized, transported, and displayed using existing transportation and merchandizing channels.

SUMMARY OF THE INVENTION

The invention satisfies these needs in the art by providing apparatus and methods for packaging and distributing combinations of complementary items as single, palletizable products. A combined package according to the invention includes a first container containing a first item and a second container containing a second item that complements the first item. A packaging material at least partially surrounds both the first and second containers, thus holding the first and second containers in mutual abutment. The containers can be shaped and positioned relative to one another such that the combined package has an overall shape that is generally rectanguloidal and suitable for palletization.

In general, a package according to the invention can contain any two or more complementary items. That is, the item in container 14 serves as an inducement to the consumer to purchase the item in container 12, and vice versa.

A packaging material, which can be a transparent, polymeric, packaging material, such as shrink-wrap material or a band, at least partially surrounds both complementary containers, thus holding the complementary containers in mutual abutment. The combined package can also include an adhesive between the containers that holds a face of the first container and a face of the second container in mutual abutment. To increase package strength and to facilitate palletizing the combined packages, the surface areas of the faces can be approximately the same, and the combined package can have an overall shape that is generally rectanguloidal.

Apparatus according to the invention for manufacturing a combined package can include a conveyance system, and a packaging material applicator, such as a band applicator or shrink-wrap applicator. The conveyance system transports the complementary containers while they are positioned adjacent to one another. The applicator at least partially surrounds both of the complementary containers with a packaging material that holds them in mutual abutment by applying the packaging material to both of the containers while they are positioned adjacent to one another. The applicator can include a heat source that shrinks the packaging material or fuses loose ends of the band material together to hold the complementary containers in mutual abutment.

The apparatus can also include a first conveyor that transports the first container and provides the first container to the conveyance system, and a second conveyor that transports the second container and provides the second container to the conveyance system. The first conveyor and the second conveyor meet at a junction adapted to position the complementary containers adjacent to one another. An adhesive sprayer can be used to apply an adhesive to at least one of the complementary containers to hold the containers in mutual abutment.

BRIEF DESCRIPTION OF THE DRAWING

The foregoing summary, as well as the following detailed description of the preferred embodiments, is better understood when read in conjunction with the appended drawing. For the purpose of illustrating the invention, there are shown in the drawing embodiments that are presently preferred, it being understood, however, that the invention is not limited to the specific methods and instrumentalities disclosed.

DETAILED DESCRIPTION OF PREFERRED EMBODIMENTS

Figure 1:
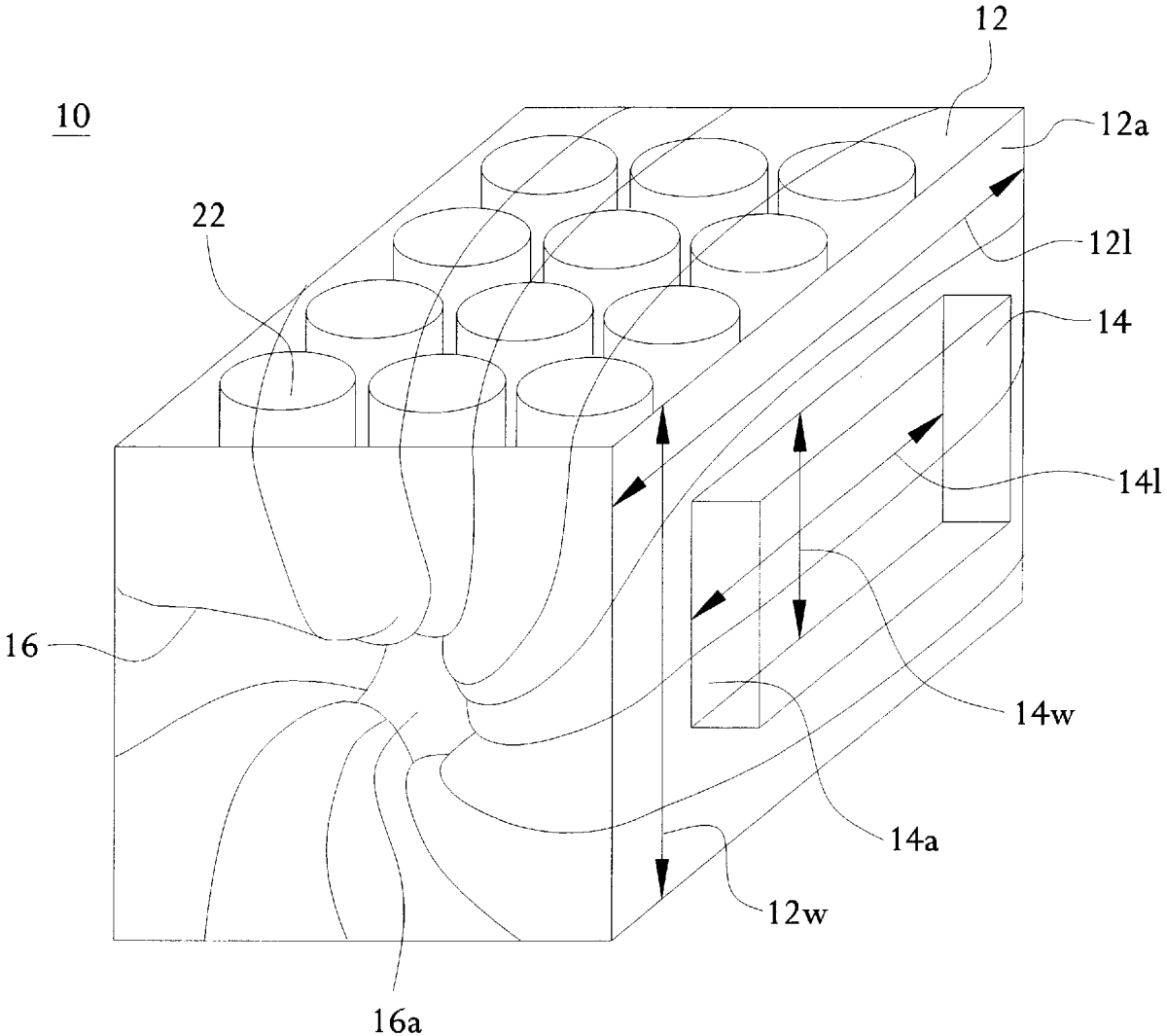
FIG. 1 depicts a preferred embodiment of a package according to the invention for combinations of complementary items.
Figure 2B:
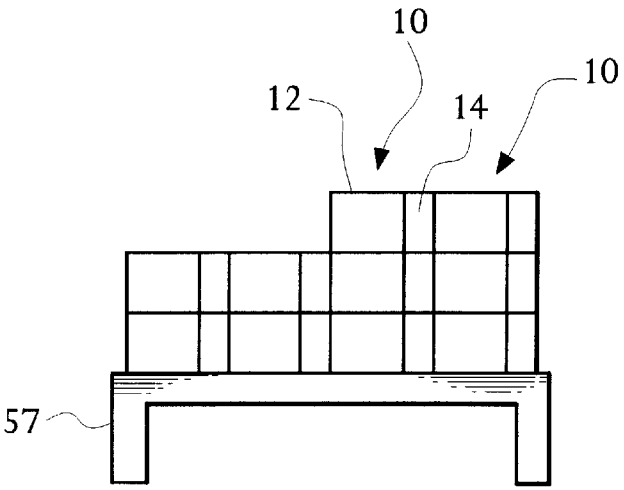
FIGS. 2A and 2B depict a preferred embodiment of a combined package according to the invention that is particularly suitable for palletizing.
Figure 2A:
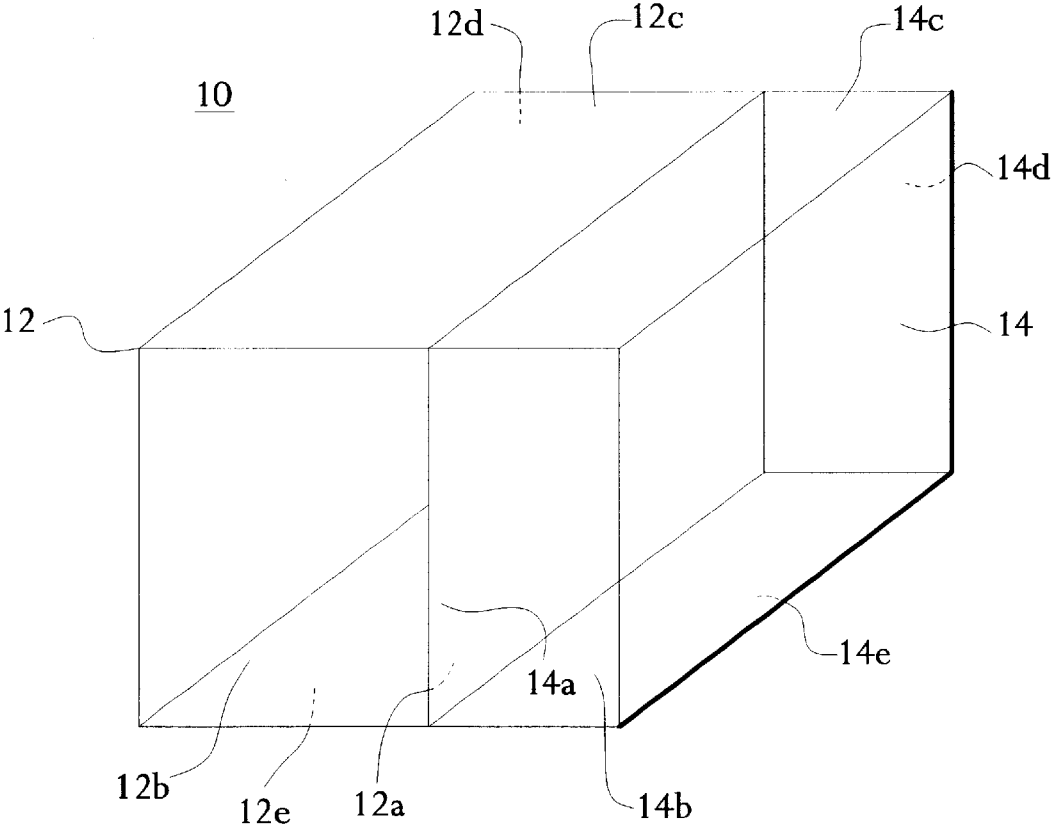

FIG. 1 depicts a preferred embodiment of a package 10 according to the invention. As shown, package 10 comprises a first container 12 and a second container 14. According to the invention, container 12 contains a first item and container 14 contains a second item that complements the first item. That is, the item in container 14 serves as an inducement to the consumer to purchase the item in container 12, and vice versa. Thus, containers 12 and 14 are complementary to one another.

Preferably, container 12 contains a plurality of beverage containers 22, as shown in FIG. 1. Beverage containers 22 can be cans, bottles, aseptic cartons, or the like. In a preferred embodiment, container 12 contains twelve cans of a beverage such as soda, beer, water, or the like. In an embodiment of the invention wherein container 12 contains a plurality of beverage containers, container 14 preferably contains a snack food item, such as popcorn, peanuts, pretzels, potato chips, or the like, that is complementary to the beverage. Alternatively, container 14 can contain a promotional item or "premium," such as a toy, tee shirt, video, or the like.

A packaging material 16 at least partially surrounds both containers 12, 14, and thus holds container 12 and container 14 against one another in combination, i.e., in mutual abutment. Preferably, packaging material 16 is a sheet of transparent material, such as a sheet of transparent polymeric material commonly known as "shrink-wrap," for example. It should be understood that the packaging material applies a constrictive force to both complementary containers 12, 14 to hold them in mutual abutment.

Each container 12, 14 can be made of cardboard, or any other suitable material, and can include artwork, trademarks, or other attractive design work designed to enhance the appeal of the package 10. It is preferred that the packaging material 16 is transparent so that the consumer can see both containers 12, 14, though it may be desirable to use colored or printed packaging material to further enhance the marketing appeal of the combined package 10. The combined package 10 can then be offered for sale as a single product or stock keeping unit (SKU), and labeled with a single product identifier, such as a universal product code (UPC).

The containers 12 and 14 are positioned relative to one another such that a face 12*a* of container 12 is in abutment with a face 14*a* of container 14. Preferably, container 14 is configured such that face 14*a* of container 14 has a length 14*l* that is approximately the same as a corresponding length 12*l* of face 12*a* of container 12. More preferably, to facilitate palletizing the combined packages, face 14*a* of container 14 also has a width 14*w* that is approximately the same as a corresponding width 12*w* of face 12*a* of container 12. Thus, in a preferred embodiment, face 12*a* has approximately the same surface area as face 14*a*. Preferably, each of the containers 12 and 14, as well as the combined package 10, has a generally rectanguloidal overall shape.

Figure 4B:
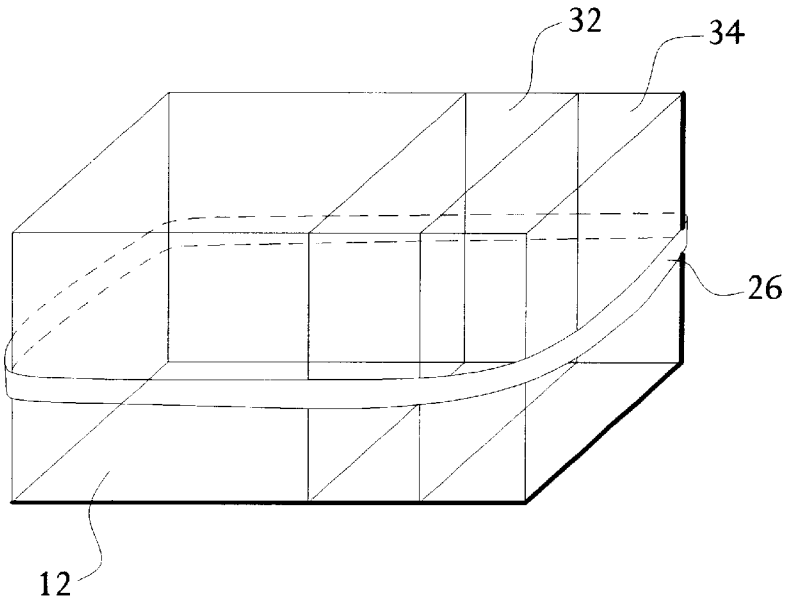
FIGS. 4A and 4B depict alternate embodiments of a combined package according to the invention that are particularly suitable for stacking.
Figure 4A:
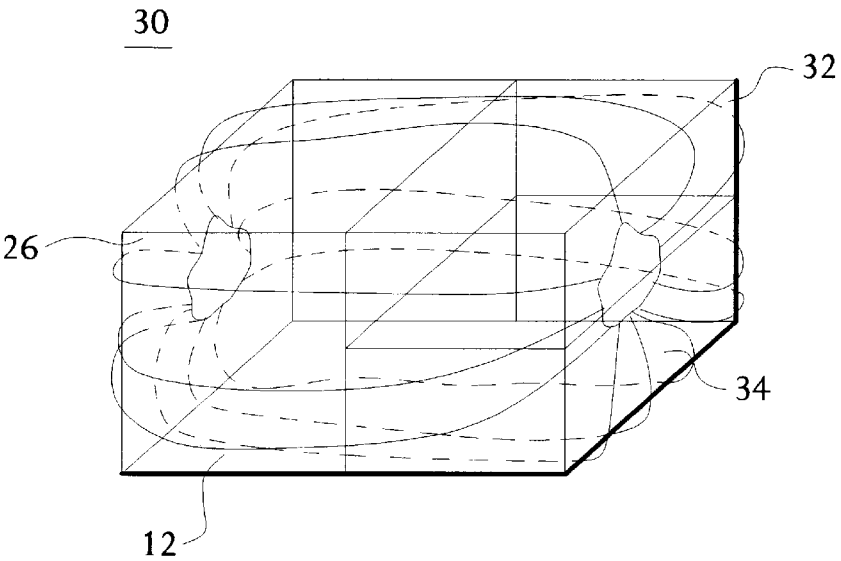

FIG. 4A depicts a preferred embodiment of a combined package 10 according to the present invention that is particularly suitable for palletizing. As shown, the overall shape of package 10 is rectanguloidal. Such a rectanguloidal shape facilitates palletizing and display of a plurality of such packages because the packages 10 can be stacked next to or on top of one another, in any orientation, without significant gaps between adjacent packages (see FIG. 4B). The containers 12 and 14 can be sized, shaped, and positioned relative to one another such that faces 12*b*, 12*c*, 12*d*, and 12*e* of container 12 are generally coplanar with faces 14*b*, 14*c*, 14*d*, and 14*e*, respectively, of container 14. Because any number of such combined packages can be stacked in any orientation, a combined package having a generally rectanguloidal shape is preferred as it facilitates the manufacture, transportation, storage, display, and marketing of the combined package 10. It is believed that the combined package 10 will be stronger if the faces are oriented in such a generally co-planar arrangement. This additional strength is desirable as it provides stability for transportation.

Figure 5:
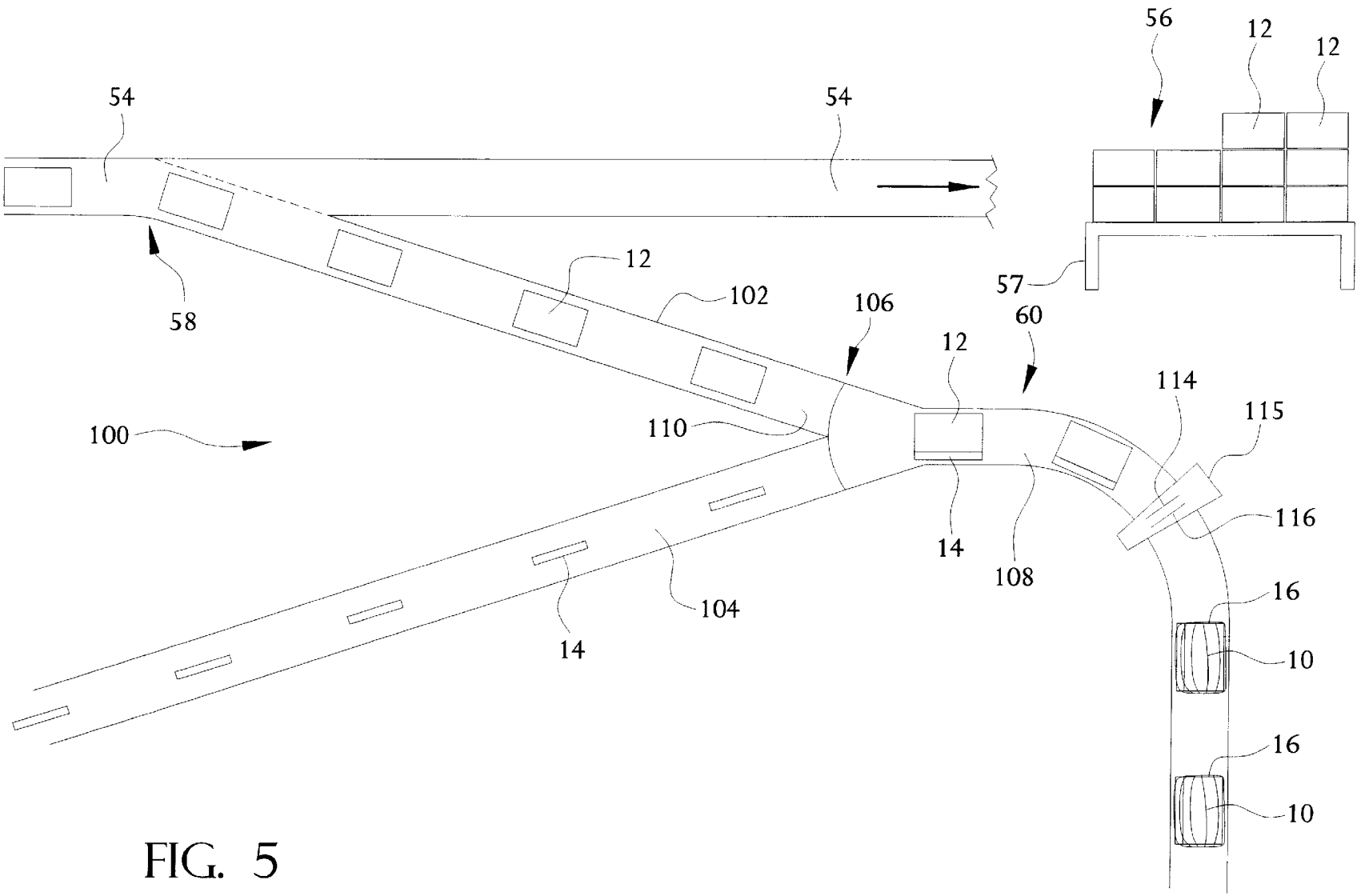
FIG. 5 depicts an apparatus according to the invention for packaging combinations of complementary items.

FIG. 5 depicts another preferred embodiment of a combined package 20 according to the invention. As shown, packaging material 26 can be a strap, belt, belly band, or any other configuration that wraps around four sides of the combined package 20, thereby holding containers 12 and 14 in mutual abutment. Preferably, packaging material 26 is made from a transparent or translucent polymeric material, though it may be desirable to use colored or printed packaging material to further enhance the marketing appeal of combined package 20. As shown, the packaging material 26 can include a handle 28, via which the combined package 20 can be lifted. Additional description of belly-bands can be found in U.S. Pat. Nos. 4,919,260 and 4,269,308, the contents of each of which are hereby incorporated herein by reference.

FIGS. 7A and 7B depict alternate embodiments of a combined package 30 according to the invention that are particularly suitable for palletizing. As shown, package 30 includes a first complementary container 12, a second complementary container 32, and a third complementary container 34. Such embodiments are particularly useful in applications wherein the seller of the combined package is desirous of marketing more than two complementary items. For example, such an embodiment would be useful to sell beer, tortilla chips, and salsa as a single combined package.

The second and third containers 32 and 34 can be disposed such that each is adjacent to the first container 12, as shown in FIG. 7A, or such that the second container 32 is adjacent the first container 12 and the third container 34 is adjacent the second container 32, as shown in FIG. 7B. It is contemplated that the combined package 30 can include any number of complementary containers. In any event, the complementary containers 12, 32, and 34 are preferably sized and shaped such that the overall shape of the combined package is generally rectanguloidal.

In general, a package according to the invention can contain any two or more complementary items. Table 1 provides several examples of such complementary items. It should be understood, however, that the scope of the invention is in no way limited to the specific examples provided herein.

| BASE ITEM | COMPLEMENTARY ITEM |
|---|---|
| Beverages | Snack foods |
| Dog food | Dry dog food; dog biscuits, chew bones, toys, collars |
| Cat food | Dry cat food, toys, collars |
| Motor Oil | Filters, funnels, rags |
| Baby formula | Diapers, play toys, wipes |
| Chili | Tortilla chips, salsa |
| Soup | Crackers, premiums (e.g., cups) |
| Cereal | Premiums, aseptic containers of milk |
| Croutons | Salad dressing |
| Taco shells | Salsa, chilies |
| Cake mix | Frosting |
| Pancake mix | Syrup |
| Aseptic beverage cartons | Snacks, premiums |
| Laundry detergent | Softener, bleach, dryer sheets |
| Diapers | Toys, wipes, cookies |
| Pasta | Pasta sauce |
| Boxed tea (e.g., 3-pack) | Cookies, tea biscuits |
| Bandages | Antiseptic cream |

Figure 3:
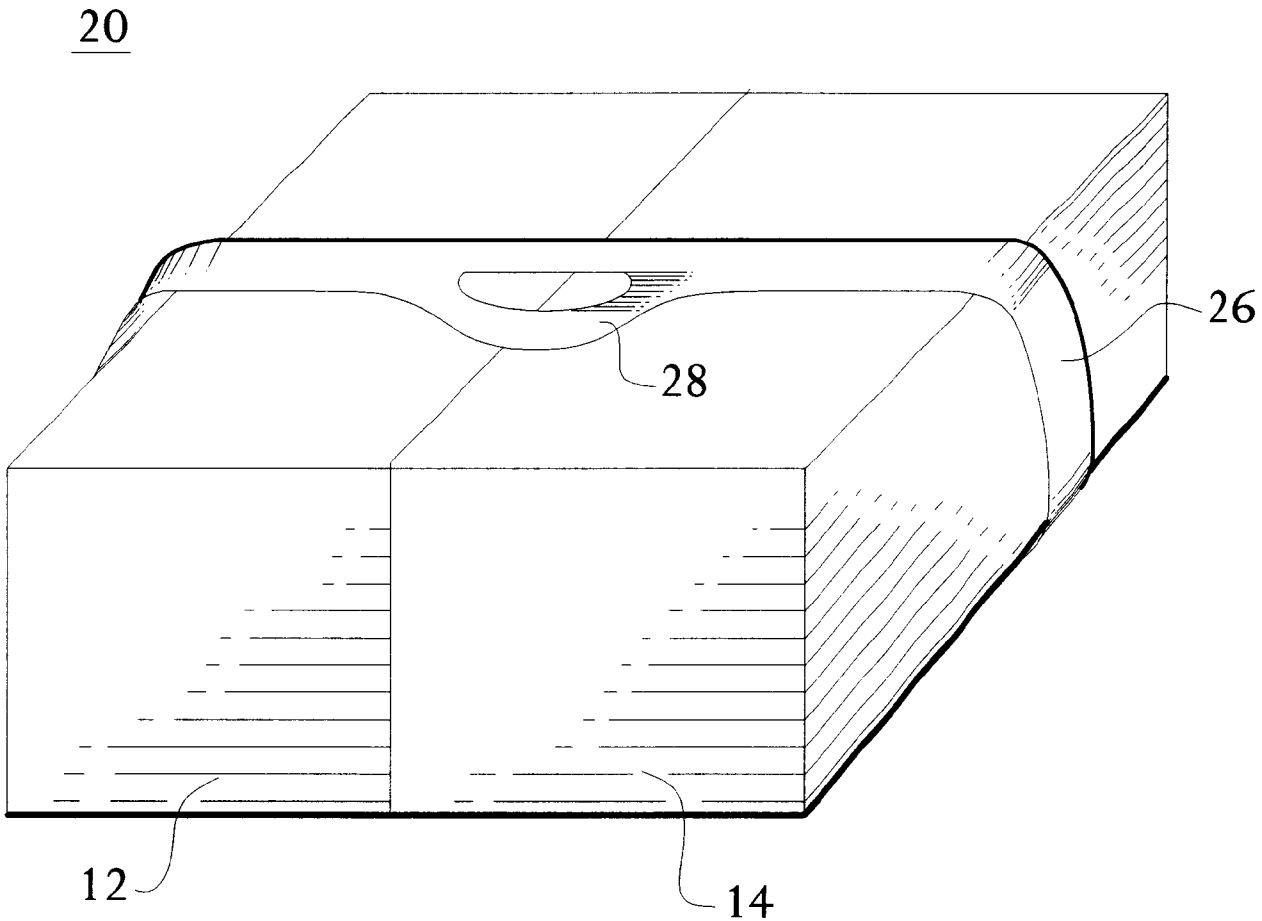
FIG. 3 depicts another embodiment of a combined package according to the invention.

Apparatus and methods according to the present invention for manufacturing combinations of complementary containers will now be described. FIG. 3 depicts a preferred embodiment of apparatus 100 according to the invention for manufacturing combinations of complementary containers. As shown, a conveyor 54 can include a switch 58 so that containers 12 can either continue along conveyor 54 to be "palletized" (i.e., stacked on pallets 57) at a palletizing area 56, or be switched off via a conveyor 102 to a packaging area 60. Alternatively, conveyor 102 can be separate from conveyor 54, with containers 12 being loaded onto conveyor 102 from a remote location (not shown).

In any event, conveyor 102 preferably transports containers 12 at predefined intervals from one another (i.e., there is preferably a predefined distance between successive containers on conveyor 102). Similarly, a second conveyor 104 transports containers 14 at predefined intervals from one another. Conveyors 102 and 104 meet at a junction 106, where they can continue side-by-side (i.e., adjacent to one another). More preferably, conveyors 102 and 104 end at junction 106, where a third conveyor 108 begins. Thus, junction 106 can be adapted to cause the complementary containers 12, 14 to come into mutual abutment. The intervals between containers 14 should be set so that containers 12 and containers 14 arrive at junction 106 concurrently. Preferably, containers 12 and containers 14 are oriented on their respective conveyors 102, 104 so that when containers 12 and containers 14 meet at junction 106, containers 12 and containers 14 abut against one another as shown. Thus, at junction 106, container 12 and container 14 are positioned relative to one another such that face 12*a* of container 12 is in abutment with face 14*a* of container 14 (see FIG. 1).

It is desirable that the positions of container 12 and container 14 remain as fixed as possible relative to one another before and during the application of the packaging material 16. To accomplish this, as shown in FIG. 3, an adhesive sprayer 110 can be used to apply an adhesive either to face 12*a* of container 12 or to face 14*a* of container 14 or to both. When container 12 and container 14 come into contact at junction 106, the two will be adhered together, and thus, container 12 and container 14 can be maintained in mutual abutment as they continue along conveyor 108.

Preferably, conveyor 108 carries container 12 and container 14 into a wrap applicator 114 that places a sleeve or wrap of shrink film around container 12 and container 14 in combination. Preferably, wrap applicator 114 accomplishes this through a series of stretch rollers that cover the combined package 10 with complete 360 degree coverage, leaving only a "bullseye" opening 16*a* (see FIG. 1) on each end. A heater 116 heats the shrink film to cause it to shrink into tight, surrounding engagement with containers 12 and 14.

Preferably, wrap applicator 114 and heater 116 are parts of a shrink wrap machine 115, also known as a "heat shrink tunnel." After it has been shrunk, packaging material 16 contains containers 12 and 14 in combination, with only the bullseye openings 16*a* at each end remaining after combined package 10 has passed through heat shrink tunnel 115. Packages 10 can continue along conveyor 108, to a location (not shown) where they can be palletized or otherwise unloaded for storage and shipment (as shown in FIG. 4B, for example).

Figure 6:
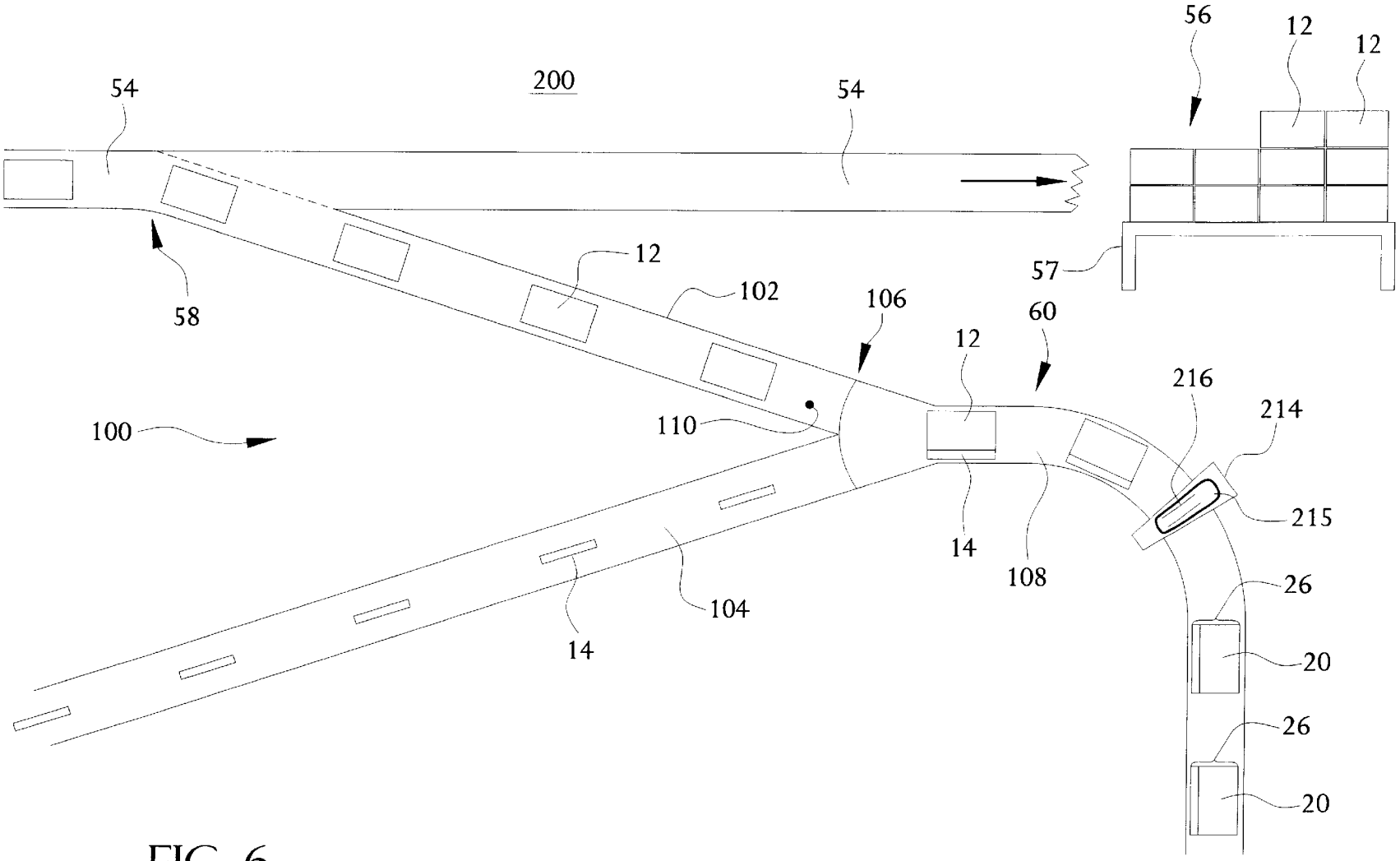
FIG. 6 depicts an alternative embodiment of an apparatus according to the present invention for packaging combinations of complementary items.

FIG. 6 depicts a preferred embodiment of apparatus 200 for manufacturing combined packages 20 according to the present invention. As shown, conveyor 54 can include a switch 58 so that containers 12 can either continue along conveyor 54 to be "palletized" (i.e., stacked on pallets 57) at a palletizing area 56, or be switched off via conveyor 102 to packaging area 60. Alternatively, conveyor 102 can be separate from conveyor 54, with containers 12 being loaded onto conveyor 102 from a remote location (not shown).

In any event, conveyor 102 preferably transports containers 12 at predefined intervals from one another (i.e., there is preferably a predefined distance between successive containers on conveyor 102). Similarly, second conveyor 104 transports containers 14 at predefined intervals from one another. Conveyors 102 and 104 meet at junction 106, where they can continue side-by-side (i.e., adjacent to one another). More preferably, conveyors 102 and 104 end at junction 106, where conveyor 108 begins. Thus, junction 106 can be adapted to cause the complementary containers 12, 14 to come into mutual abutment. The intervals between containers 14 should be set so that containers 12 and containers 14 arrive at junction 106 concurrently. Preferably, containers 12 and containers 14 are oriented on their respective conveyors 102, 104 so that when containers 12 and containers 14 meet at junction 106, containers 12 and containers 14 abut against one another as shown. Thus, at junction 106, container 12 and container 14 are positioned relative to one another such that face 12*a* of container 12 is in abutment with face 14*a* of container 14 (see FIG. 1).

It is desirable that the positions of container 12 and container 14 remain as fixed as possible relative to one another before and during the application of the packaging material 16. To accomplish this, as shown in FIG. 3, an adhesive sprayer 110 can be used to apply an adhesive either to face 12*a* of container 12 or to face 14*a* of container 14 or to both. When container 12 and container 14 come into contact at junction 106, the two will be adhered together, and thus, container 12 and container 14 can be maintained in mutual abutment as they continue along conveyor 108.

Conveyor 108 carries container 12 and container 14 into a band applicator 214 that places a plastic strap, belt, or belly-band around container 12 and container 14, thereby holding them in mutual abutment. Preferably, band applicator 214 includes a band roller 215. Band roller 215 is a roller or spool onto which a string of belly band material is wound. As the containers 12, 14 pass through band applicator 214, band roller 215 rotates and the belly band material unwinds from the spool 215. The belly band 26 is wrapped around the complementary containers 12, 14 in combination. The belly band 26 is cut off of the spool 215, and the loose ends of the band 26 are fused together, via a heater, laser, or other such heat source 216, thereby holding the complementary containers 12, 14 in mutual abutment to form the combined package 20.

Alternatively, the belly-band 26 can be wrapped around the complementary containers 12 and 14 like a rubber band. The heat source 216 can be used to shrink the belly band 26 snugly onto the containers 12 and 14, thereby forming the combined package 20. Packages 20 can continue along conveyor 108, to a location (not shown) where they can be palletized or otherwise unloaded for storage and shipment.

Thus, there have been described apparatus and methods for packaging combinations of complementary items. Those skilled in the art will appreciate that numerous changes and modifications may be made to the preferred embodiments of the invention and that such changes and modifications may be made without departing from the spirit of the invention. It is therefore intended that the appended claims cover all such equivalent variations as fall within the true spirit and scope of the invention.

I claim:

1. A method for manufacturing a combined package, the method comprising:

providing a first, generally rectanguloidal container that contains plurality of individual containers each containing a first item;

providing a second, generally rectanguloidal container containing a second item that is complementary to and different from the first item, wherein the second container is separate from the first container; and applying a packaging material that applies a constrictive force that holds the containers in mutual abutment such that the combined package has an overall shape that enables a plurality of said combined packages to be stacked next to as well as on top of one another on a pallet.

2. The method of claim 1, wherein the individual containers are cans or bottles, and the first container contains at least six individual containers.

3. The method of claim 2, wherein the first container contains twelve individual containers.

4. The method of claim 1, wherein the packaging material is a sheet of polymeric material.

5. The method of claim 1, wherein the packaging material is transparent.

6. The method of claim 1, wherein the packaging material is a shrink-wrap material.

7. The method of claim wherein the first container has a first face that is generally coplanar with a respective first face of the second container.

8. The method of claim 1, wherein the first container has a plurality of faces, the second container has a plurality of faces, and each face of the first container is generally coplanar with a respective face of the second container.

9. A method for manufacturing a combined package, the method comprising:

providing a multi-pack carton containing a plurality of individual containers each containing a first item;

providing a complementary container containing a second item that is complementary to and different from the first item, wherein the complementary container is separate from the multi-pack carton; and at least partially surrounding both the multi-pack carton and the complementary container with a packaging material that applies a constrictive force that holds the multi-pack carton and the complementary container in mutual abutment.

10. The method of claim 9, wherein the individual containers are beverage containers.

11. The method of claim 10, wherein the second item is a snack food item.

* * * * *

UNITED STATES PATENT AND TRADEMARK OFFICE

CERTIFICATE OF CORRECTION

PATENT NO. : 6,679,029 B2
DATED : January 20, 2004
INVENTOR(S) : Forrest Kelly Clay It is certified that error appears in the above-identified patent and that said Letters Patent is hereby corrected as shown below:

Column 1,
Line 16, delete “h em” and insert -- herein --;

Column 8,
Line 15, after “claim” insert --1 --.

Signed and Sealed this

Nineteenth Day of October, 2004

JON W. DUDAS
*Director of the United States Patent and Trademark Office*